US006550299B1

(12) United States Patent
Lin

(10) Patent No.: US 6,550,299 B1
(45) Date of Patent: Apr. 22, 2003

(54) CYLINDER LOCK ADAPTABLE FOR DIFFERENT KEYS

(76) Inventor: Sheng-Ting Lin, No. 5, Li-Hsing Lane, Chung-Cheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/122,826

(22) Filed: Apr. 15, 2002

(51) Int. Cl.[7] ..... E05B 27/00; E05B 29/00

(52) U.S. Cl. ..... 70/491; 70/375; 70/378; 70/382

(58) Field of Search ..... 70/491, 492, 373, 70/375, 378, 384, 385, 403, 404, 416, 419, 490, 367, 381, 382

(56) References Cited

U.S. PATENT DOCUMENTS 3,411,331 A * 11/1968 Schlage ..... 70/491
3,422,646 A * 1/1969 Monahan ..... 70/491
3,903,720 A * 9/1975 Scherbing ..... 70/491
4,621,510 A * 11/1986 Scherbing ..... 70/491
4,802,354 A * 2/1989 Johnson ..... 70/491
4,858,455 A * 8/1989 Kuo ..... 70/491
4,858,456 A * 8/1989 McGee, Sr. ..... 70/491
5,018,376 A * 5/1991 Lee ..... 70/491
6,357,271 B1 * 3/2002 Hsu ..... 70/491

* cited by examiner

*Primary Examiner*—Anthony Knight
*Assistant Examiner*—John B. Walsh
(74) *Attorney, Agent, or Firm*—Alan Kamrath; Kider, Bennett, Egan & Arundel, LLP

(57) ABSTRACT

A cylinder lock has a first tumbler, a second tumbler and a third tumbler all received in a hollow cylindrical housing. The first tumbler is selectively rotatable relative to the second tumbler and the second tumbler together with the first tumbler is selectively rotatable to the third tumbler. By pressing downward the actuating pin, a rearrangement between first tumbler pins and second tumbler pins by relative rotation of the first tumbler to the second tumbler adapts to a different key.

7 Claims, 4 Drawing Sheets

CYLINDER LOCK ADAPTABLE FOR DIFFERENT KEYS

BACKGROUND OF THE INVENTION

1. Field of the Invention

The present invention relates to a cylinder lock, and more particularly to a cylinder lock having an actuating pin receivable at an interface of the second tumbler and the third tumbler so as to lock the second and third tumblers together to allow rearrangement of the first and second tumbler pins in the first and second tumblers respectively to be ready for different keys.

2. Description of Related Art

A conventional cylinder lock generally is equipped with a specific key to activate/deactivate the locking mechanism of the lock. This kind of cylinder lock is widely used in public facilities such as the locker in the train and bus stations. The key for the cylinder lock has a circular distal edge with recesses and extensions of different depths and lengths so that the key when inserted into the cylinder lock is able to push specific tumbler pins in different tumblers to allow relative rotation between two specific tumblers. Thus, the user is able to activate the cylinder lock. If this kind of cylinder lock is used for public storage and the key for a specific lock is lost, the maintenance personnel may need to change the entire lock in order to avoid potential loss of goods received and locked in the compartment. Taking another example for example, if student A graduates or is transferred to another school, the locker originally belonging to student A is now available for student B. Student B might need a brand new lock to lock his/her personal belongings, which is quite an unnecessary cost. However, to avoid personal belongings being stolen, changing the entire lock seems to be the most effective way to solve the problem, regardless of the cost and effort involved.

To overcome the shortcoming, the present invention tends to provide an improved cylinder lock to mitigate and obviate the aforementioned problems.

SUMMARY OF THE INVENTION

The primary objective of the present invention is to provide an improved cylinder lock in which the interior structure is able to be changed to adapt for different keys so as to avoid the change of the entire lock.

In order to accomplish the foregoing objective, the cylinder lock has a hollow cylindrical housing, a first tumbler with first tumbler pins insertable in the periphery thereof, a second tumbler selectively and rotatably connected to the first tumbler and having second tumbler pins insertable in the periphery thereof and a third tumbler with third tumbler pins. The second tumbler has an activating pin selectively received between an interface of the first and second tumblers so as to lock the first and second tumblers and an interface of the second and third tumblers so as to lock the second and third tumblers. When the second and third tumblers are locked together, the first tumbler is able to rotate relative to the second tumbler so that the second tumbler pins are able to be rearranged in the second tumbler due to the alignment of the blind holes in the second tumbler to the holes in the first tumbler. That is, when the second and third tumblers are secured with each other, rotation of the key drives only the simultaneous rotation of the first tumbler so that some of the second tumbler pins extend out of the second tumbler and the others are received in the second tumbler, which changes the interior structure of the cylinder lock so that the user is able to use another key to activate/deactivate the locking mechanism of the cylinder lock.

Other objects, advantages and novel features of the invention will become more apparent from the following detailed description when taken in conjunction with the accompanying drawings.

DETAILED DESCRIPTION OF THE PREFERRED EMBODIMENT

Figure 1:
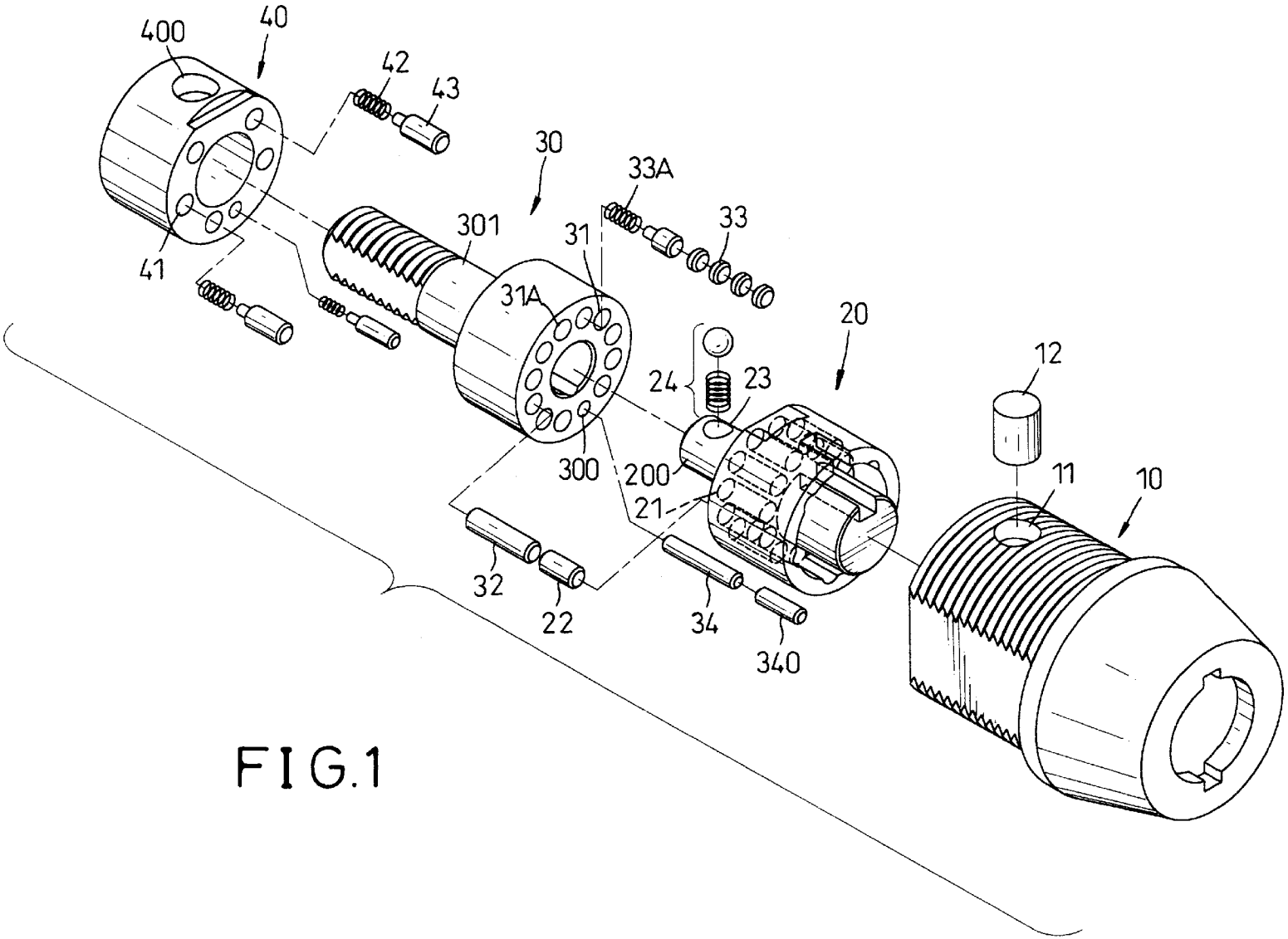
FIG. 1 is an exploded perspective view of the cylinder lock of the present invention.

With reference to FIG. 1, the cylinder lock in accordance with the present invention has a housing (10), a first tumbler (20), a second tumbler (30) and a third tumbler (40).

The housing (10) is hollow and cylindrical in shape. A pin hole (11) is peripherally defined through a periphery thereof to receive a lock pin (12). The first tumbler (20) is received in the housing (10) and has first through holes (21) defined through a bottom face to receive therein first tumbler pins (22). The first tumbler (20) further has an extension (200) extending out therefrom and having a first hole (23) defined to receive therein a ball-spring combination (24).

Figure 4:
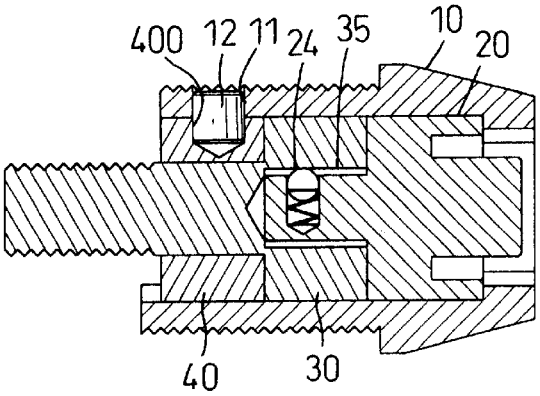
FIG. 4 is a cross sectional side view of the assembled lock in FIG. 3.
Figure 3:
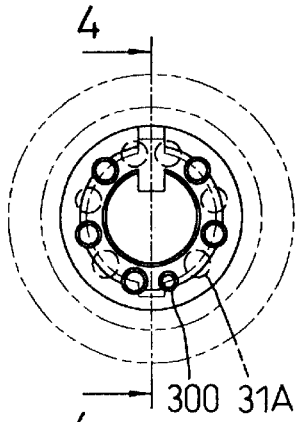
FIG. 3 is an end view of the lock showing the original position of the lock.

The second tumbler (30) has a head (not numbered) and an extension (301) integrally formed with the head. The head has second through holes (31) receiving therein second tumbler pins (32). At least one receiving recess (35), as shown in FIG. 4, corresponding to the ball-spring combination (24) is defined in an inner periphery of the extension (301). Blind holes (31A) are defined in the head to selectively correspond to the first through holes (21) of the first tumbler (20) and each blind hole (31A) is provided to receive therein pads (33) and a spring (33A). That is, the head has both the second through holes (31) and the blind holes (31A). An actuating pin hole (300) is also defined in the head to receive therein a positioning pin (340) and an actuating pin (34).

The third tumbler (40) is hollow and has blind holes (41) defined in a distal end face thereof to correspond to the second through holes (31) and to receive therein second springs (42) and third tumbler pins (43). A receiving recess (400) is defined in a periphery thereof to correspond to the pin hole (11) of the first tumbler (10).

Figure 2:
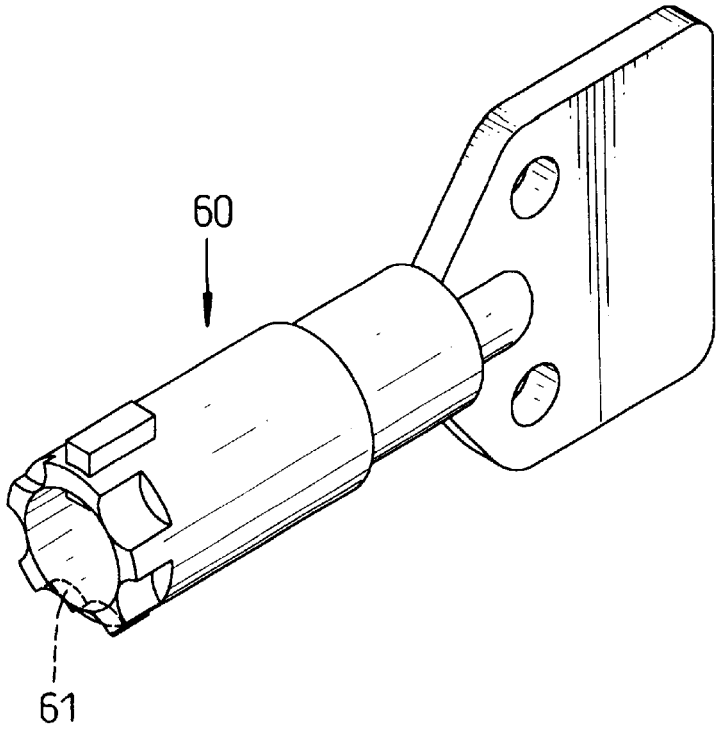
FIG. 2 is a perspective view of the master key and a secondary key both used for the lock of the present invention.
Figure 2:
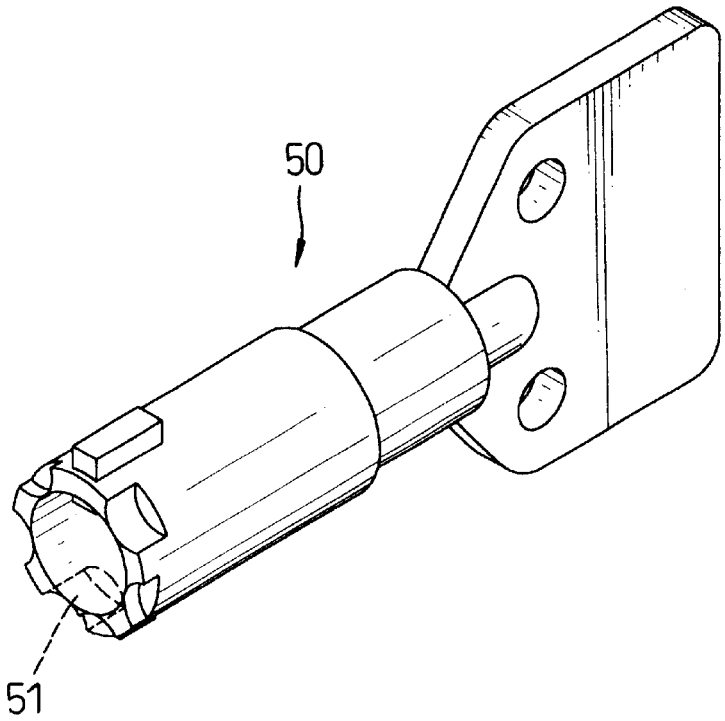

With reference to FIG. 2, a master key (50) and a secondary key (60) are shown. The master key (50) has a first cutout (51) and the secondary key (60) has a second cutout (61) having a depth larger than that of the first cutout (51). Both the first and second cutouts (51,61) are defined to correspond to the actuating pin hole (300) in the second tumbler (30). Because the assembly of the lock is known in the art and a skilled person in the art is able to readily assemble the lock after the foregoing description, detailed description of how the lock is assembled is omitted in the following description.

Figure 6:
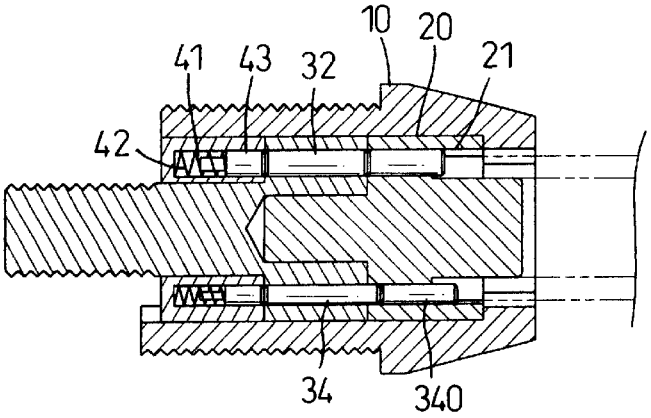
FIG. 6 is a cross sectional side view of the lock in FIG. 5.
Figure 5:
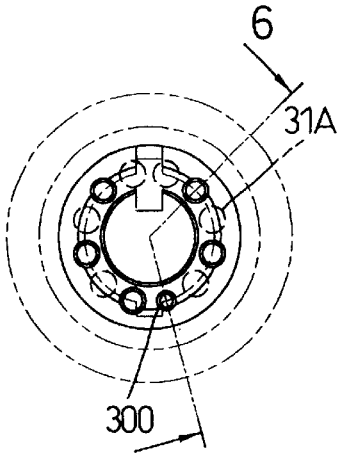
FIG. 5 is an end view of the lock in a different angle relative to the lock in FIG. 3.

With reference to FIGS. 3, 4, 5 and 6, after the parts in FIG. 1 is assembled and before the interior structure of the lock is changed, it is to be noted that the lock pin (12) is inserted into the pin hole (11) of the first tumbler (10) and the receiving recess (400) of the third tumbler (40) to secure the engagement between the first and third tumblers (10,40). The ball-spring combination (24) is received in the first hole (23) and is slidable in the at least one receiving recess (35) so that when there is a relative rotation between the first and the second tumblers (10,20), the sound of the ball of the ball-spring combination (24) entering and leaving the at least one receiving recess (35) indicates the angle of the rotation of either the first or the second tumblers (10,20). Furthermore, the second through holes (31) in the second tumbler (30) communicate with the first through holes (21) in the first tumbler (20). Because the blind holes (41) of the third tumbler (40) communicate with the second through holes (31) so that the spring (42) not only urges the third tumbler pin (43), but also the urging force to the third tumbler pin (43) urges the second tumbler pin (32), as well as the actuating pin (34) and the positioning pin (340) in the second tumbler (30). At the status as shown in FIG. 6, the actuating pin (34) is located at an interface between the first tumbler (20) and the second tumbler (30). However, there is nothing between the interface between the second tumbler (30) and the third tumbler (40). Accordingly, when a user rotates a key (as shown in phantom lines), the first and second tumblers (20,30) rotate with regard to the third tumbler (40).

Figure 8:
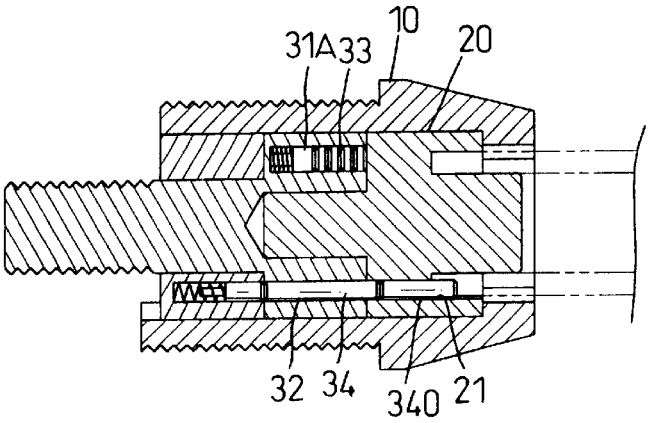
FIG. 8 is a cross sectional view of the lock in FIG. 7.
Figure 7:
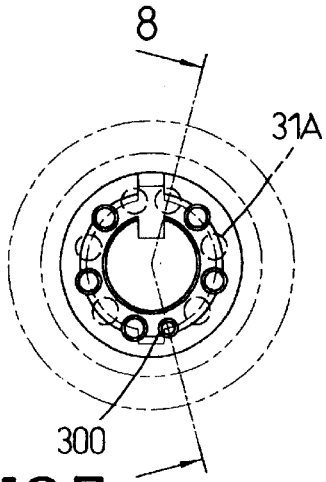
FIG. 7 is an end view showing still another angle of the assembled lock of the present invention.

With reference to FIGS. 7 and 8, as stated before, the communication between the first and second through holes (21,31) is remained due to the existance of the actuating pin (34) at the interface of the first and second tumblers (20,30). However, the blind holes (31A) in the second tumbler (30) do not communicate with the first through holes (21) in the first tumbler (20) because there is no relative between the first tumbler (20) and the second tumbler (30). Therefore, the pads (33) in the blind holes (31A) of the second tumbler (30) remain inside the second tumbler (30).

Figure 10:
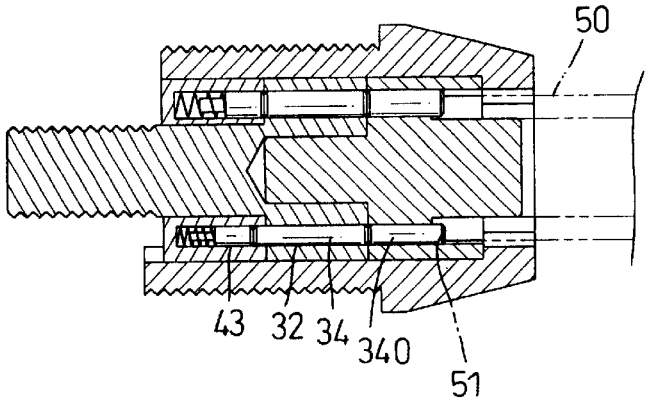
FIG. 10 is a cross sectional side view of the lock in FIG. 9.
Figure 9:
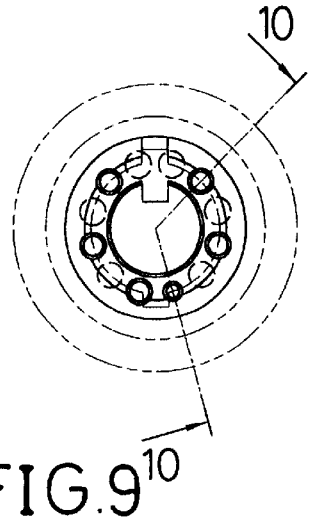
FIG. 9 is an end view showing that a secondary key is inserted into the lock to push inward the actuating pin to lock the second tumbler and the third tumbler together.

With reference to FIGS. 9 and 10, when the master key (50) is inserted into the housing (10) of the lock of the present invention, the first tumbler pins (22) will be pushed toward the second tumbler (30) due to the various indentations (not numbered) each having a depth different to one another. Also, positioning pin (340) as well as the actuating pin (34) will be pushed to move toward one of the blind holes (41) of the third tumbler (40). After the actuating pin (34) is partially received in one of the blind holes (41) of the third tumbler (40), the second tumbler (30) and the third tumbler (40) are secured relative to each other. That is, there is no relative rotation between the second tumbler (30) and the third tumbler (40). However, due to the movement of the positioning pin (340) and the actuating pin (34) toward the third tumbler (40), the interface between the first and second tumblers (20,30) is free of first tumbler pins (22) or second tumbler pins (32). Rotation of the master key (50) to a predetermined angle will drive the first tumbler (20) to rotate simultaneously. At this position, the blind holes (31A) in the second tumbler (30) communicate with the first through holes (21) in the first tumbler (20). Therefore, the pads (33) in the blind holes (31A) will be pushed by the springs (33A) to move toward the first through holes (21) in the first tumbler (20) to compensate the loss of space due to the rotation of the first tumbler (20) relative to the second tumbler (30), as shown in FIGS. 11 and 12.

Figure 12:
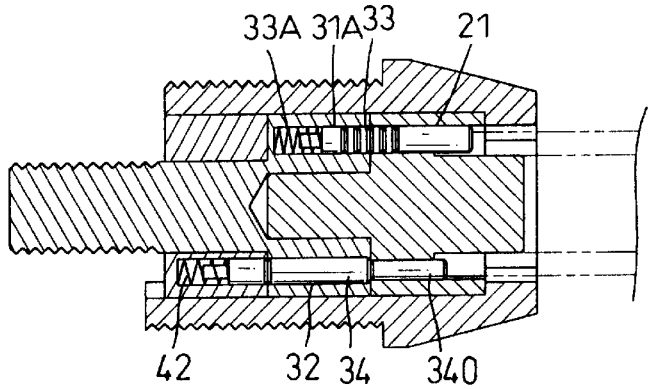
FIG. 12 is a cross sectional view of the lock in FIG. 11.
Figure 11:
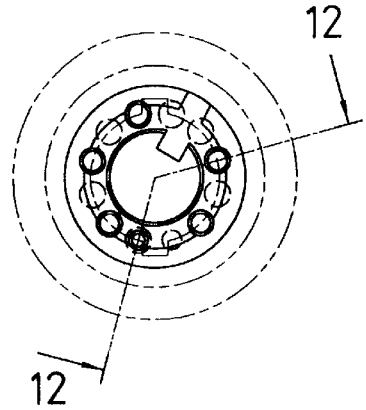
FIG. 11 is an end view of the lock in a different angle relative to the status in FIG. 9.

After the compensation of the pads (33) to the first through holes (21) in the first tumbler (20), the interior structure of the lock of the invention is changed, as shown in FIGS. 11 and 12.

Figure 14:
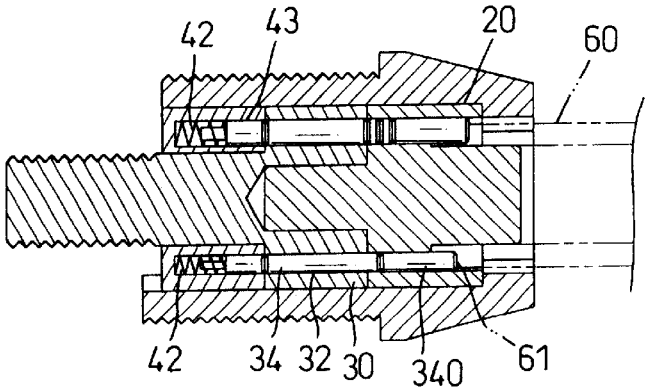
FIG. 14 is a cross sectional view of the lock in FIG. 13.
Figure 13:
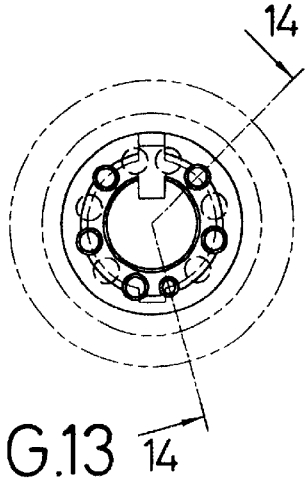
FIG. 13 is an end view showing that a second secondary key is used due to the change in the interior structure caused by the master key.

With reference to FIGS. 13 and 14, after the interior structure of the lock is changed, the master key (50) is removed and a secondary key (60) is inserted into the lock of the present invention. It is to be noted that due to the second cutout (61) being deeper than that of the first cutout (51) of the master key (50), the insertion of the secondary key (60) will push the positioning pin (340) as well as the actuating pin (34) toward the second tumbler (30). As a result of the insertion of the secondary key (60), the positioning pin (340) will remain between the interface of the first tumbler (20) and the second tumbler (30), which secures the engagement between the first tumbler (20) and the second tumbler (30). After the first tumbler (20) and the second tumbler (30) are locked by the positioning pin (340), the secondary key (60) is rotated to return the lock to its original position. After the secondary key (60) is rotated to return the lock to its original position, a part of the pads (33) are then kept in the first through holes (21) of the first tumbler (20) and therefore, only the secondary key (60) is able to activate the lock.

However, when the lock is about to change to another secondary key (60), the user will have to use the master key (50) again to push the positioning pin (340) and the activating pin (34) so as to ensure the interface between the first tumbler (20) and the second tumbler (30) is free of the existence of the positioning pin (340) and the activating pin (34) is maintained at the interface of the second tumbler (30) and the third tumbler (40). Then, the user may proceed the foregoing process to change the interior structure of the lock for the change of another secondary key (60).

It is to be noted that the master key (50) corresponds to a specific secondary key (60). Therefore, if the user wants to change to another secondary key (60), the user will have to use the original master key (50) to activate the rearrangement of the interior structure of the lock and then the desired secondary key (60) to secure the structural change of the lock.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cylinder lock comprising:

a hollow cylindrical housing having a pin hole defined through a periphery thereof;

a first tumbler rotatably received in the housing and having a body, a skirt extending out of the body, first through holes defined between a periphery of the skirt and a periphery of the body for movably receiving therein first tumbler pins and a hole defined in the periphery of the body to correspond to the pin hole of the housing;

a second tumbler selectively rotatable with respect to the first tumbler and having a head with second through holes corresponding to the first through holes for movably receiving therein second tumbler pins, an extension extending out of the head and having a second hole defined therein to correspond to the hole of the first tumbler for movably receiving therein a first spring and a first pressing pin which is receivable in the hole of the body so as to allow a relative rotation between the first and second tumblers; and a third tumbler receiving therein the first and second tumblers and received in the housing, the third tumbler having third through holes for receiving therein second springs and second pressing pins to engage with second tumbler pins of the second tumbler and a third hole corresponding to the second hole for movably receiving therein an actuating pin which has a distal end selectively located between a periphery of the third tumbler and a periphery of the second tumbler so that the second and the third tumblers are selectively and securely engaged with each other, whereby a downward movement of the actuating pin into the second hole to press the first pressing pin downward into the hole of the body of the first tumbler secures the engagement between the second tumbler and the third tumbler and also allows a relative rotation of the first tumbler to the second tumbler so as to rearrange a corresponding relationship of the first through holes and the second through holes, and thus a different key is adaptable to operate the rearranged structure.

2. The cylinder lock as claimed in claim 1, wherein a quantity of the first through holes is smaller than a quantity of the second through holes.

3. The cylinder lock as claimed in claim 2, wherein a quantity of the second through holes is the same as a quantity of the third through holes.

4. The cylinder lock as claimed in claim 1, wherein the second tumbler pin is a combination of first pads and second pads.

5. The cylinder lock as claimed in claim 3, wherein the second tumbler pin is a combination of first pads and second pads.

6. The cylinder lock as claimed in claim 1, wherein the first pressing pin is movably located between a first position and a second position, whereby when the first pressing pin is at the first position, the first and second tumblers are secured together and the second tumbler together with the first tumbler is able to rotate relative to the third tumbler, and when the first pressing pin is at the second position, the second and third tumblers are secured together and the first tumbler is able to rotate relative to the second tumbler.

7. The cylinder lock as claimed in claim 5, wherein the first pressing pin is movably located between a first position and a second position, whereby when the first pressing pin is at the first position, the first and second tumblers are secured together and the second tumbler together with the first tumbler is able to rotate relative to the third tumbler, and when the first pressing pin is at the second position, the second and third tumblers are secured together and the first tumbler is able to rotate relative to the second tumbler.

* * * * *